US005182068A

United States Patent [19]

Richardson

[11] Patent Number: 5,182,068

[45] Date of Patent: Jan. 26, 1993

[54] HIGH SPEED SPINNING PROCESS

[75] Inventor: John Richardson, Gloucester, England

[73] Assignee: Imperial Chemical Industries PLC, London, England

[21] Appl. No.: 696,202

[22] Filed: May 6, 1991

[30] Foreign Application Priority Data

May 22, 1990 [GB] United Kingdom ..... 9011464

[51] Int. Cl.[5] ..... D01D 5/12; D01F 6/60; D01F 6/62

[52] U.S. Cl. ..... 264/210.8; 264/211.15; 264/211.17

[58] Field of Search ..... 264/210.8, 211.14, 211.15, 264/211.17

[56] References Cited

U.S. PATENT DOCUMENTS

| | | | |
|---|---|---|---|
| 3,361,859 | 1/1968 | Cenzato | 264/210.8 |
| 4,045,534 | 8/1977 | Fisher et al. | 264/211.15 |
| 4,134,882 | 1/1979 | Frankforet | 264/210.8 |
| 4,491,657 | 1/1985 | Saito et al. | 264/210.8 |
| 4,691,003 | 9/1987 | Sze | 528/272 |
| 5,034,182 | 7/1991 | Sze et al. | 264/210.8 |

FOREIGN PATENT DOCUMENTS

| | | | |
|---|---|---|---|
| 42664 | 12/1981 | European Pat. Off. . | |
| 244216 | 11/1987 | European Pat. Off. . | |
| 199917 | 10/1985 | Japan | 264/210.8 |
| 113817 | 5/1986 | Japan | 264/210.8 |
| 1231215 | 10/1986 | Japan | 264/210.8 |
| 6905 | 1/1987 | Japan | 264/210.8 |

OTHER PUBLICATIONS

Patent Abstracts of Japan, vol. 14, No. 115 (C-696) [4058], Polyester Yarn and Production thereof *abstract*.

Patent Abstracts of Japan, vol. 12, No. 132, Apr. 22, 1988, (C-490) [2979], Spinning Block For Melt Spinning, *abstract*.

Patent Abstracts of Japan, vol. 13, No. 208, May 16, 1989, (C-596) [3556], Method For Melt Spinning Thermoplastic Polymer *abstract*.

Patent Abstracts of Japan, vol. 12, No. 421, Nov. 8, 1988, (C-541) [3268], High-Speed Spinning of Polyester Fiber *abstract*.

*Primary Examiner*—James Lowe

*Attorney, Agent, or Firm*—Cushman, Darby & Cushman

[57] ABSTRACT

A process for the melt spinning of a fibre forming polymer into a filamentary yarn in which the spinning threadline is passed through a heated shroud located immediately below the spinneret, the threadline is cooled by an air current and then taken up at a speed of 5 km/min or more the improvement being that the temperature of the environment within the shroud, and in consequence the temperature of the filaments themselves, is progressively reduced, before the filaments in the threadline are cooled by the air current.

1 Claim, 3 Drawing Sheets

HIGH SPEED SPINNING PROCESS

This invention relates to a process for producing an oriented polymeric filamentary yarn in a directly usable as-spun condition by spinning a fibre-forming polymer at high speeds of the order of 5 km/min or more without recourse to a subsequent drawing stage.

BACKGROUND OF THE INVENTION

1. Field of the Invention

The process of the invention is distinct from the well established processes for producing partially oriented yarn (POY) at lower spinning speeds, for example in the range 3,000 to 4,500 meters/minute. Such (POY) yarns have too high an extension for direct use in a fabric and the yarn requires to be drawn in order to reduce its extension. This drawing stage is often combined with a bulking step.

Experiments have demonstrated that as the spinning speed increases above 5 km/min there is a very rapid increase in stress applied to the threadline in the spinning chimney with much of the draw down occurring within a few centimeters resulting in a neck draw ratio of up to 6.0 and the likelihood of breakage. To be able to operate at even higher speeds it is apparent that the maximum stress, maximum strain rate and, hence, "neck draw ratio" need to be reduced.

Attempts at reducing the "neck draw ratio" by the use of a constant temperature heated shroud immediately below the spinneret have resulted in the draw down point or neck being moved by a distance almost exactly the length of the shroud with only a small increase in yarn velocity prior to the 'neck' formation.

2. Description of Related Art

In European Patent Application Nos. 244,217 and 245,011; and U.S. Pat. No. 4,687,610 (all to E. I. Du Pont de Neumours and Company) various techniques are described to control the attenuation profiles of a threadline at high spinning speeds. In European Patent Nos. 244,217 and 245,011 there is described a process for preparing polymeric filaments, wherein the freshly extruded filaments enter an enclosed zone that is maintained at super atmospheric pressure by a controlled flow of air at a low positive pressure, and the filaments leave the zone through a constriction, either a venturi or a tube, assisted by the concurrent flow of such air at a controlled high velocity. In this process the extent of "necking down" that would otherwise be normally experienced by the filaments at the high spinning speeds employed is appreciably reduced so that the filaments are oriented more highly and more uniformly (less difference between amorphous sections and crystalline sections).

In U.S. Pat. No. 4,687,610 a somewhat similar process is described in which the threadline, after leaving the spinneret, passes first through an enclosed chamber supplied with a pressurised gas and then through a tube attached to the underside of the chamber. The tube is also supplied with a pressurised gas. In the process, the velocity profile of the spinning filaments increased smoothly to the final take up velocity without sign of any sudden velocity change or "neck" formation. In British Patent No. 1391471 (Hoechst Aktiengesellschaft) there is described a heater for use in the production of spun filaments having a low degree of pre-orientation i.e. POY yarns. The heater comprises two parts, each of which has the shape of a hollow truncated cone, which are attached to each other at their larger circular openings. The lower part is heated while the inside wall of the upper part reflects the heat emitted by the lower part. The spinning threadline is thus subjected to a variation in temperature as it passes through the heater.

In Japanese Patent Nos. 51067-422 (Teijin) there is described a process in which the spinning polyester threadline is passed through a controlled temperature gradient heating atmosphere. The polyester fibre is taken up at a low speed of 2 km/min. In Japanese Patent Nos 59001-713-A and 58203-112-A (both Toray) the spinning threadline is passed through a heated tube immediately below the spinneret. The temperature in the tube is kept at between the melting point of the polymer and 400° C. with the temperature gradually decreasing downwards. The spun fibre is taken up at a speed between 1.5 and 3 km/min. Japanese Patent No. 62250213 A (Teijin) also describes the use of a cylindrical heater immediately below the spinneret, such heater allowing a decreasing temperature distribution profile to be imparted to the freshly spun filaments in a direction parallel to the filaments. Though the patent refers to spinning speeds of 3 km/min or more, a reading of the specification makes it clear that the described process produces POY yarns and that a subsequent drawing stage is required.

The temperature gradient heating environments used in British Patent No. 1391471 and the above Japanese Patents merely serve to control the physical properties of the spun filaments and/or prevent thermal deterioration of the molten polymer. There is no suggestion that the use of these environments could also be used to reduce "neck draw ratio" in a spinning threadline. Indeed in the spinning of POY yarns 'necking' does not occur.

SUMMARY OF THE INVENTION

We have now found that advantages can be achieved in a process for producing a polymeric filamentary yarn in an as-spun condition using take up speeds of the order of 5 km/min or more if the spinning threadline, immediately after leaving the spinneret, is passed through a heated shroud in which the temperature of the environment, and therefore of the filaments themselves, is progressively reduced before cooling air is applied. More particularly the presence of this shroud increases the speed of the filaments prior to 'necking' and hence reduces the 'effective neck draw ratio'.

According to the invention, therefore, we provide a process for the melt spinning of a fibre forming polymer into a filamentary yarn in which the spinning threadline is passed through a heated shroud located immediately below the spinneret, the threadline is cooled by an air current and then taken up at a speed of 5 km/min or more characterised in that the temperature of the environment within the shroud, and in consequence the temperature of the filaments themselves, is progressively reduced, before the filaments in the threadline are cooled.

According to another aspect of the invention we provide a process for the melt spinning of polyethylene terephthalate or polyhexamethylene adipamide into a filamentary yarn in which the spinning threadline is passed through a heated shroud located immediately below the spinneret, the threadline is cooled by an air current and then taken up at a speed of 7 km/min or more characterised in that the temperature of the environment within the shroud, and in consequence the temperature of the filaments themselves, is progressively reduced, before the filaments in the threadline are cooled such that the neck draw ratio which occurs in the filaments is 3.0 or less.

By "neck draw ratio" we mean the ratio of the velocity of the threadline after the onset of necking divided by the velocity of the threadline before the onset of necking.

DESCRIPTION OF PREFERRED EMBODIMENTS

The invention will now be described with reference to the following Examples. Examples 1 and 2 are provided to show that 'neck' formation does not occur in the production of POY yarn. Examples 3 and 4 are provided to show the increasingly poor processability of both polyester and polyamide yarns at speeds in the range 5 km/min to 7 km/min. Example 5 shows the effect of a constant temperature shroud on the spinning of PET at 7 km/min. Examples 6 and 7 specifically relate to the invention.

EXAMPLE 1

Production of Polyester Poy Yarn

Figure 1:
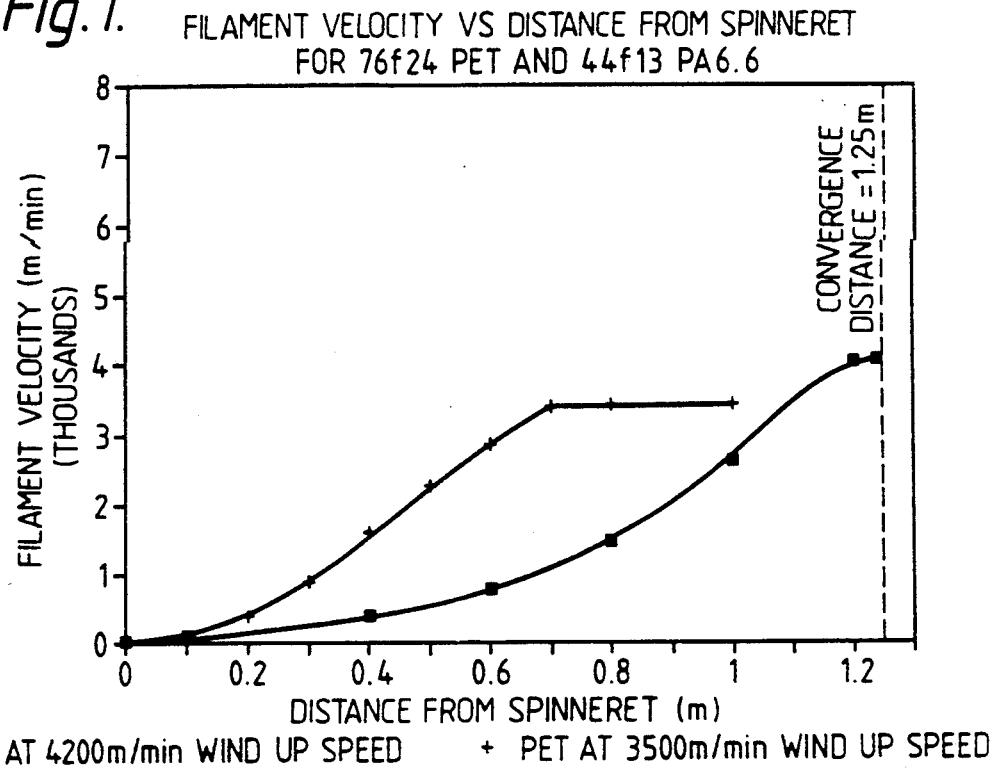
FIG. 1 illustrates the results obtained producing polyester yarn in Example 1.

Polyethylene terephthalate, having a relative viscosity of 1.63 measured in m-cresol (1% w/w), was extruded at a temperature of 290° C. through 24 holes of 0.36 mm diameter at a rate of 1.75 g/min/hole. The filaments are passed through a quench chamber, 1.2 m in length, where they are cooled with a cross-flow of air travelling at 0.3 m/sec. After applying finish to the yarn, the yarn passes over two godets and is wound up to 3500 m/min giving a 120f24 yarn with a tenacity of 26.5 cN/tex and an extension of 112%. During the manufacture of the yarn, the velocity of the filaments was measured at various distances from the spinneret and the results are shown in FIG. 1. The velocity of the filaments increases smoothly to the final speed without any sign of a sudden increase in velocity or "neck" formation. This yarn is not suitable for direct use.

The yarn was subsequently drawn at a draw ratio of 1.61 to give a 76f24 yarn with a tenacity of 43 cN/tex and an extension of 30%. This yarn was of good quality and eminently suitable for use in fabric manufacture.

EXAMPLE 2

Production of Polyamide Poy Yarn

Polyhexamethyleneadipamide, having a relative viscosity of 40 measured as an 8.4% soln in 90% formic acid, was extruded at a temperature of 285° C. through 13 holes of 0.33 mm diameter at a rate of 1.42 g/min/-hole. The filaments are passed through a quench chamber, 1.2 m in length, where they are cooled with a cross-flow of air travelling at 0.3 m/sec. After applying finish to the yarn, the yarn passes over two godets and is wound up at 4200 m/min giving a 44f13 yarn with a tenacity of 36 cN/tex and an extension of 66%. During the manufacture of the yarn, the velocity of the filaments was measured at various distances from the spinneret and the results are shown in FIG. 1. The velocity of the filaments increases smoothly to the final speed without any sign of a sudden increase in velocity or "neck" formation. This yarn is not suitable for direct use except in special circumstances but is more usually drawn subsequently.

EXAMPLE 3

Production of Polyester Yarns in the Speed Range 5000–7000 M/Min

Figure 2:
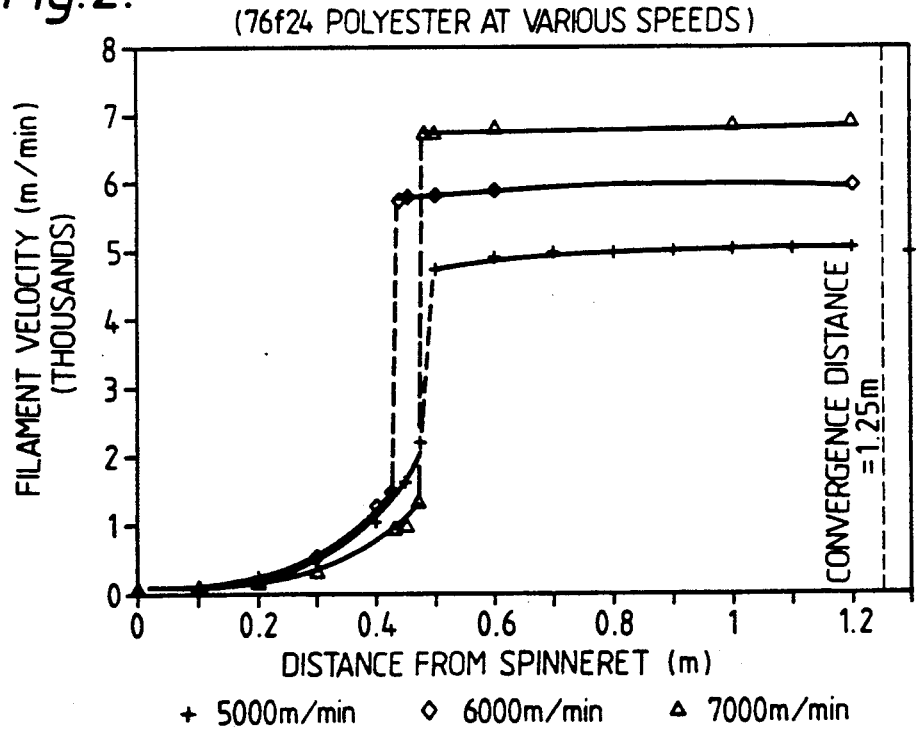
FIG. 2 illustrates the results obtained in Example 3 for the production of polyester yarns in the speed range 5000–7000 M/Min.

Polyethylene terephthalate, having a relative viscosity of 1.63 measured in m-cresol (1% w/w), was extruded through 24 holes. Details of the spinning temperature, spinneret hole dimensions and spinneret hole throughputs at the various speeds are given in Table 1. The filaments are passed through a quench chamber, 1.2 m in length where they are cooled with a cross-flow of air travelling at 0.3 m/sec. After applying finish to the yarn, the yarn passes over two godets and is wound up at various speeds in each case to give a yarn of 76f24. During the manufacture of the yarn, the velocity of the filaments was measured at various distances from the spinneret and the results are shown in FIG. 2. The velocity of the filaments does not increase smoothly to the final speed, there being a sudden increase in velocity with the formation of a "neck". The "neck draw ratio" is also given in Table 1. Processability was poor at the highest speed, 7000 m/min, making it impossible to achieve a satisfactory break rate.

EXAMPLE 4

Production of Polyamide Yarns in the Speed Range 5000–7000 M/Min

Figure 3:
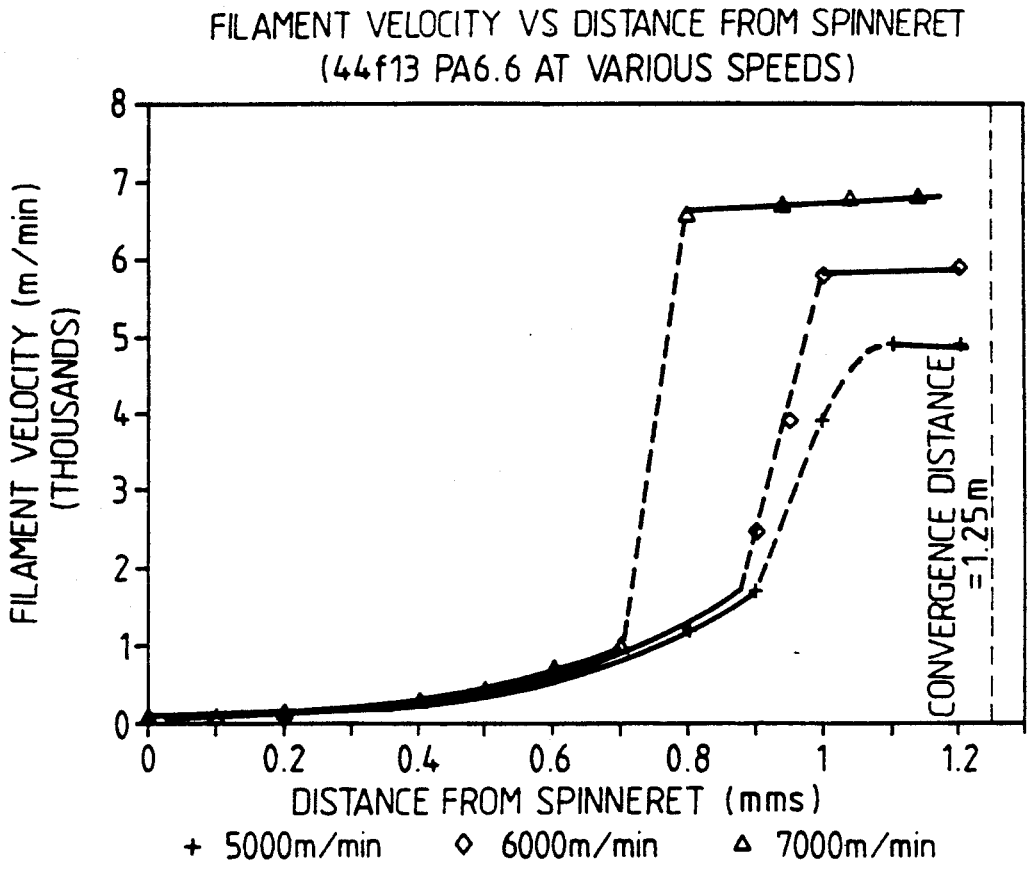
FIG. 3 illustrates the results obtained in Example 4.

Polyhexamethyleneadipamide, having a relative viscosity of 40 measured as an 8.4% soln in 90% formic acid, was extruded at a temperature of 285° C. through 13 holes. Details of the spinning temperature, spinneret hole dimensions and spinneret hole throughputs at the various speeds are given in Table 2. The filaments are passed through a quench chamber, 1.2 m in length, where they are cooled with a cross-flow of air travelling at 0.3 m/sec. After applying finish to the yarn, the yarn passes over two godets and is wound up at various speeds in each case to give a yarn of 44f13. During the manufacture of the yarn, the velocity of the filaments was measured at various distances from the spinneret and the results are shown in FIG. 3. The velocity of the filaments does not increase smoothly to the final speed, there being a sudden increase in velocity with the formation of a "neck". The suddenness of the velocity increase increases with increasing speed. The "neck draw ratio" is also given in Table 2. Processability was poor at the highest speed, 7000 m/min, making it difficult to achieve a satisfactory break rate.

EXAMPLE 5

Production of Pet Using a Constant Temperature Shroud at 7000 M/Min

Figure 4:
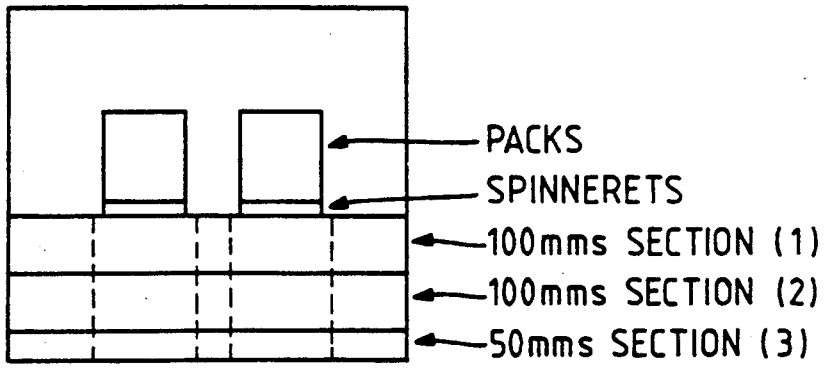
FIGS. 4 and 5 illustrate the results in Example 5 producing PET using a constant temperature shroud at 7000 M/Min.
Figure 5:
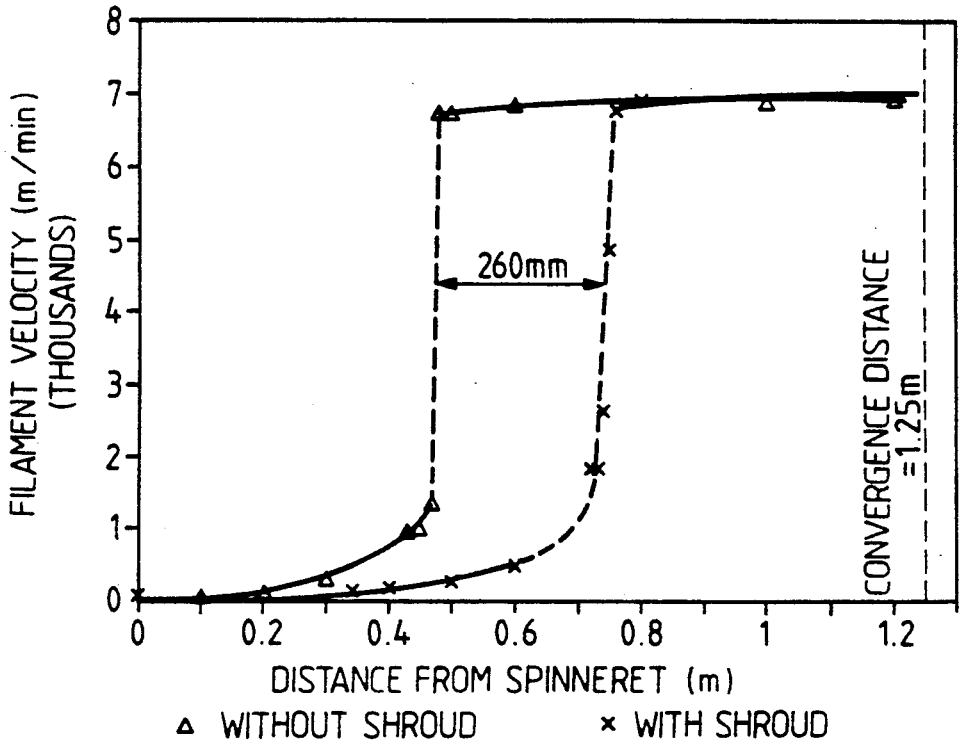

Example 3 was repeated under the conditions given for the production of 76f24 at 7000 m/min except in this case a shroud comprising three sections as shown in FIG. 4 and with a total length of 250 mm was fitted between the bottom of the spinneret and the top of the quenching cabinet. The shroud was sealed to the bottom of the pack box. The three shroud sections were set at a constant temperature of 300° C. and the velocity of the filaments measured at various distances from the spinneret, the results are shown in FIG. 5 together with those from Example 3 taken in the absence of a shroud. It can be seen that the "neck draw ratio" is reduced only by a small amount, Table 3, and that the "neck" has been displaced by a distance almost equal to the length of the shroud. Processability was somewhat improved.

EXAMPLE 6

Production of Pet Using a Profiled Temperature Shroud at 7000 M/Min

Example 5 was repeated except in this case the three sections of the shroud were heated to 300° C., 250° C. and 200° C. respectively. The "neck draw ratio" is reduced further compared with Example 5, (see Table 3) and in this case the "neck" has been displaced by a distance of 310 mm compared with the shroud length of 250 mm. Processability was improved still further.

EXAMPLE 7

Production of Pa6.6 Using a Profiled Temperature Shroud at 7000 M/Min

Figure 6:
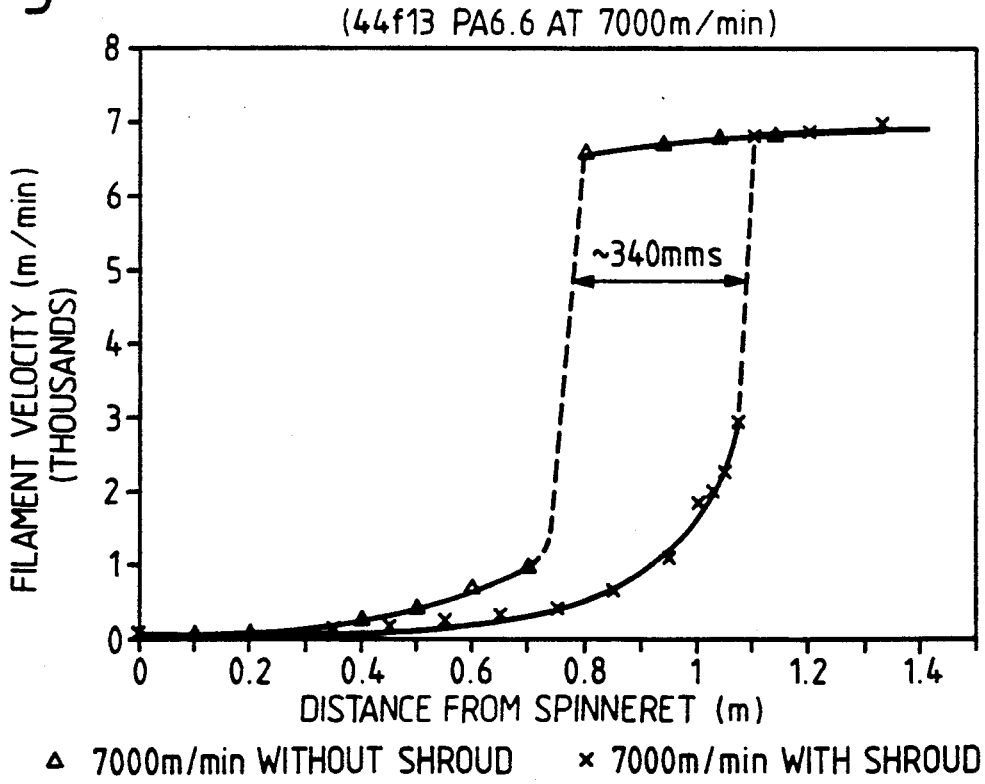
FIG. 6 illustrates the results obtained in Example 7.

Example 4 was repeated under the conditions given for the production of 44f13 at 7000 m/min except in this case a shroud as described in Example 5 was fitted, the temperatures of the three sections being 250° C., 200° C. and 150° C. respectively. The velocity of the filaments was measured at various distances from the spinneret, the results are shown in FIG. 6 together with those from Example 4 taken in the absence of a shroud. It can be seen that the "neck draw ratio" is considerably reduced (see Table 4) and that the "neck" has been displaced by a distance considerably greater than the length of the shroud. Processability was greatly improved.

TABLE 1

DETAILS OF PROCESSING CONDITIONS AND "NECK DRAW RATIO" FOR PET YARNS IN THE SPEED RANGE 5000–7000 M/MIN

| Spinning speed (m/min) | Spin box temp (C) | Spinneret hole diam (nm) | Spinneret hole L:D | Spinneret hole throughput (g/min) | "Neck draw ratio" | Length of the "neck" (mm) |
|---|---|---|---|---|---|---|
| 5000 | 290 | 0.2 | 4.0 | 1.58 | 2.1 | 25 |
| 6000 | 290 | 0.2 | 4.0 | 1.90 | 3.9– | 15 |
| 7000 | 310 | 0.2 | 4.0 | 2.22 | 5.0 | 10 |

TABLE 2

DETAILS OF PROCESSING CONDITIONS AND "NECK DRAW RATIO" FOR PA6.6 YARNS IN THE SPEED RANGE 5000–7000 M/MIN

| Spinning speed (m/min) | Spin box temp (C) | Spinneret hole diam (nm) | Spinneret hole L:D | Spinneret hole throughput (g/min) | "Neck draw ratio" | Length of the "neck" (mm) |
|---|---|---|---|---|---|---|
| 5000 | 285 | 0.2 | 4.0 | 1.69 | 2.9 | 200 |
| 6000 | 285 | 0.2 | 4.0 | 2.03 | 4.9 | 100 |
| 7000 | 285 | 0.2 | 4.0 | 2.37 | 6.7 | 80 |

TABLE 3

COMPARISON OF PET WITH AND WITHOUT A SHROUD AT 7000 M/MIN

| Shroud temp | "Neck draw ratio" | Length of the "neck" (mm) | Position of "neck" displaced by (mm) | % reduction in "neck draw ratio" due to shroud |
|---|---|---|---|---|
| (No shroud) | 5.0 | 10 | — | — |
| Constant | 4.0 | 10 | 260 | 20 |
| Profiled | 3.0 | 10 | 310 | 40 |

TABLE 4

COMPARISON OF PA6.6 WITH AND WITHOUT A SHROUD AT 7000 M/MIN

| Shroud temp | "Neck draw ratio" | Length of the "neck" (mm) | Position of "neck" displaced by (mm) | % reduction in "neck draw ratio" due to shroud |
|---|---|---|---|---|
| (No shroud) | 6.7 | 80 | — | — |
| Profiled | 2.3 | 80 | 340 | 65 |

TABLE 5

COMPARISON OF THE "NECK DRAW RATIO" OF PET AND PA6.6 AT VARIOUS SPINNING SPEEDS

| | PET | | PA6.6 | |
|---|---|---|---|---|
| Spinning speed (m/min) | "Neck draw ratio" | "Neck" length (mm) | "Neck draw ratio" | "Neck" length (mm) |
| 5000 | 2.1 | 25 | 2.9 | 200 |
| 6000 | 3.9 | 15 | 4.9 | 100 |
| 7000 | 5.0 | 10 | 6.7 | 80 |

TABLE 6

EFFECT OF THE SHROUD ON THE "NECK DRAW RATIO" AT 7000 M/MIN

| Shroud type | Polymer | "Neck draw ratio" | "Neck" length (mm) | % reduction in "neck draw ratio" due to shroud |
|---|---|---|---|---|
| Non-profiled | PET | 4 | 10 | 20 |
| Profiled | PET | 3 | 10 | 40 |
| Profiled | PA6.6 | 2.3 | 100 | 65 |

In FIG. 1, it can be seen that at typical POY speeds, 3500 m/min and 4200 m/min for PET and PA6.6 respectively, the filament velocity increases progressively with no sign of a point at which the speed increases very rapidly, i.e. there is no "neck". One would expect that at these spinning speeds, the effect of a shroud would be relatively small. Any delay in cooling might reduce yarn birefringence and increase yarn extensibility (as spun), necessitating the use of slightly higher draw ratio to give a yarn of comparable final extensibility. As a result of this higher draw ratio, the spun decitex would have to be increased to give the same final decitex, thus, increasing the throughput at spinning. Any potential benefit is therefore likely to be in terms of productivity.

As the speed increases, FIGS. 2 and 3, then for both PET and PA6.6 there comes a point at which there is a very sudden change in filament velocity over a distance of a few centimeters, i.e. the yarn appears to draw at a "neck". (This sudden change in speed might in fact occur over an even smaller distance than that indicated, especially in the case of PET, the relevant measurements not having been made). The ratio of the velocity after this sudden change divided by the velocity before the sudden change is defined as the "neck draw ratio" and is tabulated in Table 5 for spinning speeds from 5000 to 7000 m/min, an estimation of the distance over which this draw ratio occurs is also included. As the speed increases, so both the "neck draw ratio" increases and distance over which it occurs decreases. Obviously, the formation of this "neck" results in both a very high stress and strain rate at this point. It is believed that many of the filament breaks at high speed (>6500 m/min) are caused by either "too high a stress rate" or "too high a strain rate" or, in fact, "too high a neck draw ratio".

The "neck draw ratio" at a particular spinning speed would also depend upon the yarn molecular weight, the higher the molecular weight, the greater the "neck draw ratio" at a given speed.

Placing a shroud below the spinneret to delay cooling, thus, increasing the filament speed before cooling commences and, hopefully, reducing the "neck draw ratio" was an obvious step. It was rather surprising that using an uniform shroud temperature, (300° C.), resulted in only a small change in threadline velocity entering the "neck" and that the position of the "neck" had been moved by a distance approx equal to the length of the shroud (FIG. 5). Presumably, this is due to the filaments leaving the shroud being at the same temperature as they were leaving the spinneret, but travelling at a marginally higher velocity, when the cooling air is applied. The same effect could probably have been achieved by using slightly smaller spinneret holes to increase the jet velocity and no shroud.

However, using a profiled shroud, in which the temperature of the filaments environment and, therefore, of the filaments themselves are progressively reduced before the cooling air is applied, increases the speed of the filaments entering the "neck" and, hence, reduces the "effective neck draw ratio". This is shown clearly in FIG. 6 for PA6.6 at 7000 m/min. The "neck draw ratio" is considerably reduced (Table 6) and the change in the filament position where the neck occurs is greater than the length of the shroud.

I claim:

1. A process for the melt spinning of polyethylene terephthalate or polyhexamethylene adipamide into a filamentary yarn in which the spinning threadline is passed through a heated shroud located immediately below the spinneret, the threadline is cooled by an air current and then taken up at a speed of 7 km/min or more the improvement being that the temperature of the environment within the shroud, and in consequence the temperature of filaments themselves, is progressively reduced, before the filaments in the threadline are cooled by the air current such that the neck draw ratio which occurs in the filaments is 3.0 or less.

* * * * *